US011699874B2

(12) United States Patent
Oosaka et al.

(10) Patent No.: US 11,699,874 B2
(45) Date of Patent: Jul. 11, 2023

(54) ELECTRICAL CONNECTOR WITH SURROUNDING SHIELD MEMBER WITH OUTWARD PROTRUSION CONNECTED TO A CIRCUIT BOARD

(71) Applicant: Japan Aviation Electronics Industry, Limited, Tokyo (JP)

(72) Inventors: Junji Oosaka, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 11 days.

(21) Appl. No.: 17/227,857

(22) Filed: Apr. 12, 2021

(65) Prior Publication Data

US 2021/0359463 A1 Nov. 18, 2021

(30) Foreign Application Priority Data

May 13, 2020 (JP) ..... 2020-084468
May 26, 2020 (JP) ..... 2020-091146
(Continued)

(51) Int. Cl.
*H01R 13/627* (2006.01)
*H01R 12/70* (2011.01)
(Continued)

(52) U.S. Cl.
CPC ..... *H01R 13/6271* (2013.01); *H01R 12/70* (2013.01); *H01R 13/6581* (2013.01);
(Continued)

(58) Field of Classification Search
CPC ..... H01R 13/6271; H01R 12/70; H01R 13/6581; H01R 12/712; H01R 13/6582;
(Continued)

(56) References Cited

U.S. PATENT DOCUMENTS

2015/0357729 A1 12/2015 Uratani et al.
2016/0276766 A1 9/2016 Taguchi
2021/0098943 A1* 4/2021 Hayashi ..... H01R 13/6582

FOREIGN PATENT DOCUMENTS

JP 2016012553 A 1/2016
KR 20160112939 A 9/2016
KR 20170129066 A 11/2017

* cited by examiner

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

Provided is a connector including a surrounding wall with an improved strength against an outward force.

The connector of the invention includes a contact that contacts a counter contact of a counter connector, a housing to which the contact is fitted and attached, and a surrounding wall disposed to surround the housing. A gap is provided between the housing and the surrounding wall, and in a connector fitting state, the surrounding wall is in contact with a counter surrounding wall of the counter connector that has entered the gap. The surrounding wall is provided with a protrusion portion protruding outward in a second direction intersecting a first direction, and an end portion on a board side of the protrusion portion in the first direction is in contact with a board.

17 Claims, 12 Drawing Sheets

(30) Foreign Application Priority Data

| | | |
|---|---|---|
| Jun. 12, 2020 | (JP) | 2020-102280 |
| Jun. 18, 2020 | (JP) | 2020-105098 |
| Jul. 14, 2020 | (JP) | 2020-120397 |
| Jul. 16, 2020 | (JP) | 2020-121984 |

(51) Int. Cl.

| | |
|---|---|
| ***H01R 13/6581*** | (2011.01) |
| *H01R 12/71* | (2011.01) |
| *H01R 13/6594* | (2011.01) |
| *H01R 13/6582* | (2011.01) |
| *H01R 13/502* | (2006.01) |
| *H01R 13/533* | (2006.01) |

(52) U.S. Cl.
CPC ..... *H01R 12/712* (2013.01); *H01R 12/716* (2013.01); *H01R 13/502* (2013.01); *H01R 13/533* (2013.01); *H01R 13/6582* (2013.01); *H01R 13/6594* (2013.01)

(58) Field of Classification Search
CPC ..... H01R 13/6594; H01R 12/716; H01R 13/502; H01R 13/533
See application file for complete search history.

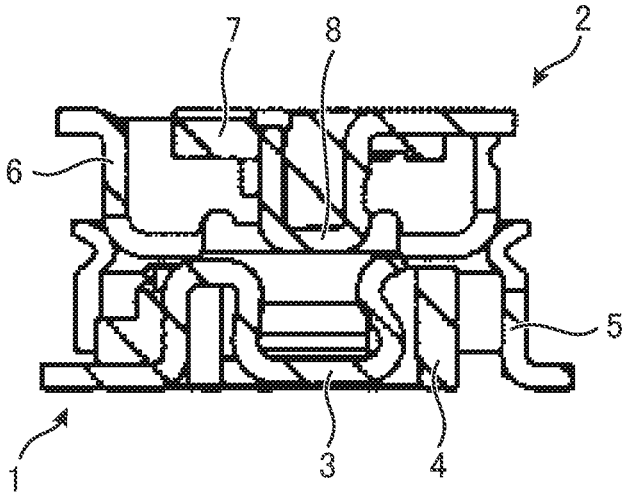
FIG. 28
PRIOR ART
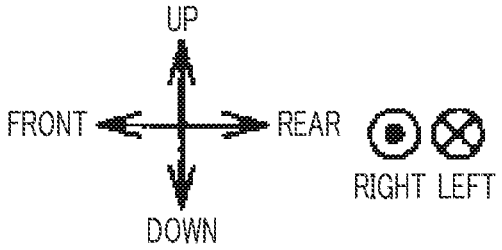

ELECTRICAL CONNECTOR WITH SURROUNDING SHIELD MEMBER WITH OUTWARD PROTRUSION CONNECTED TO A CIRCUIT BOARD

BACKGROUND OF THE INVENTION

The present invention relates to a connector, in particular, to a connector which can be fitted with a counter connector in a first direction and is mounted on a board.

An example of the connector to be fitted with a counter connector is a connector described in JP 2016-12553A (hereinafter, referred to as "connector 1"). The connector 1 is a receptacle connector and is to be fitted with a counter connector 2 that is a plug connector in a first direction (vertical direction) as shown in FIGS. 26 and 27.

As illustrated in FIG. 26, the connector 1 is configured such that a housing (insulating member) 4 that holds contacts (connection terminals) 3 is surrounded by a substantially rectangular surrounding wall (fixed terminal) 5. As illustrated in FIG. 26, the counter connector 2 holds contacts (connection terminals) 8 in a housing (insulating member) 7 disposed inside a substantially rectangular surrounding wall (fixed terminal) 6.

When the connector 1 is fitted with the counter connector 2, as shown in FIG. 28, the surrounding wall 6 of the counter connector 2 enters a gap provided between the housing 4 and the surrounding wall 5 in the connector 1.

SUMMARY OF THE INVENTION

In the connector 1 disclosed in JP 2016-12553A, in the state where the connector 1 is fitted with the counter connector 2, an outer peripheral surface of the surrounding wall 6 of the counter connector 2 is pressed against an inner peripheral surface of the surrounding wall 5 of the connector 1. Therefore, when the connector 1 is fitted to or detached from the counter connector 2, prying occurs on the counter connector 2, and a force toward the outside acts on the surrounding wall 5. The prying is a shaking movement of the counter connector 2 around a central axis extending in a front-back or right-left direction thereof.

When an outward force acts on the surrounding wall 5, the surrounding wall 5 may deform, and once the surrounding wall 5 deforms, the connector 1 may no longer be appropriately fitted to the counter connector 2, and the function of the surrounding wall 5 may be hardly exhibited.

The present invention has been made in view of the above circumstances and is aimed at attaining an object described below.

The present invention is to solve the conventional problem above and to provide a connector including a surrounding wall with an improved strength against an outward force.

In order to attain the above-described object, a connector according to one embodiment (first embodiment) of the present invention can be fitted with a counter connector in a first direction and is mounted on a board, and the connector includes: a contact that contacts a counter contact of the counter connector; a housing to which the contact is fitted and attached; and a surrounding wall disposed to surround the housing, wherein a gap is provided between the housing and the surrounding wall, wherein in a state where the connector is fitted with the counter connector, the surrounding wall is in contact with a counter surrounding wall of the counter connector that has entered the gap, wherein the surrounding wall is provided with a protrusion portion protruding outward in a second direction intersecting the first direction, and wherein an end portion of the protrusion portion on a side on which the board is situated in the first direction is in contact with the board.

According to the connector configured as above, since the protrusion portion protruding to the outside of the surrounding wall is provided and the board side end of the protrusion portion is in contact with the board, the surrounding wall can appropriately receive a reaction force from the board side when an outward force acts on the surrounding wall. As a result, the strength of the surrounding wall can be enhanced, and deformation of the surrounding wall can be satisfactorily suppressed.

A connector according to another embodiment (second embodiment) of the present invention can be fitted with a counter connector in a first direction and is mounted on a board, and the connector includes: a contact that contacts a counter contact of the counter connector; a housing to which the contact is fitted and attached; and a surrounding wall disposed to surround the housing, wherein a gap is provided between the housing and the surrounding wall, wherein in a state where the connector is fitted with the counter connector, the surrounding wall is in contact with a counter surrounding wall of the counter connector that has entered the gap, wherein the surrounding wall includes a wall body rising from the board in the first direction, a bending portion connected to the wall body on an opposite side from the board in the first direction, and an extension portion extending from the bending portion to a side on which the board is situated in the first direction, and wherein the extension portion is situated outside the wall body in a second direction intersecting the first direction, and an end on the board side of the extension portion in the first direction is in contact with the board.

According to the connector of the second embodiment, since the surrounding wall is provided with the bending portion and the extension portion, the extension portion is situated outside the wall body, and the end on the board side of the extension portion is in contact with the board, the surrounding wall can appropriately receive a reaction force from the board side when an outward force acts on the surrounding wall. As a result, the strength of the surrounding wall can be enhanced, and deformation of the surrounding wall can be satisfactorily suppressed.

BRIEF DESCRIPTION OF THE DRAWINGS

FIG. 28 is a view showing a cross-section taken along L-L in FIG. 27.

DETAILED DESCRIPTION OF THE INVENTION

Connectors according to first and second embodiments of the invention are specifically described below with reference to the appended drawings. The embodiments described below are only examples presented for easy understanding of the invention, and the invention is by no means limited thereto. In other words, the invention may be modified or improved from the embodiments described below without departing from the scope and spirit of the invention. The materials, design dimensions and other factors of components used in the invention can be freely determined depending on the application of the invention, the state of the art at the time when the invention is carried out, and other conditions. Needless to say, the invention includes its equivalents.

In addition, in the following description, three directions intersecting orthogonally to one another are defined as an X direction, a Y direction and a Z direction, and it is assumed that a direction penetrating a board CB described later, i.e., a vertical direction of the connector coincides with the Z direction. It is also assumed that a surface of the board CB on which the connector is mounted is equal to an XY plane, while a lateral width direction (right-left direction) and a front-back direction of the connector are equal to the X direction and the Y direction, respectively.

In this description, meaning of the terms "orthogonal" or "parallel" encompasses an error range generally allowed in the technical field of the connector and includes the cases where a shift within a range of less than a few degrees (e.g., 2 to 3 degrees) with respect to an exact orthogonality or parallel is present.

For convenience of description, in the following description, fitting of the connector to a counter connector is called "connector fitting," and the state where the connector is fitted with the counter connector is called "connector fitting state." In addition, detachment of the connector from the counter connector is called "connector detachment."

Configuration of Connector According to First Embodiment

Figure 10:
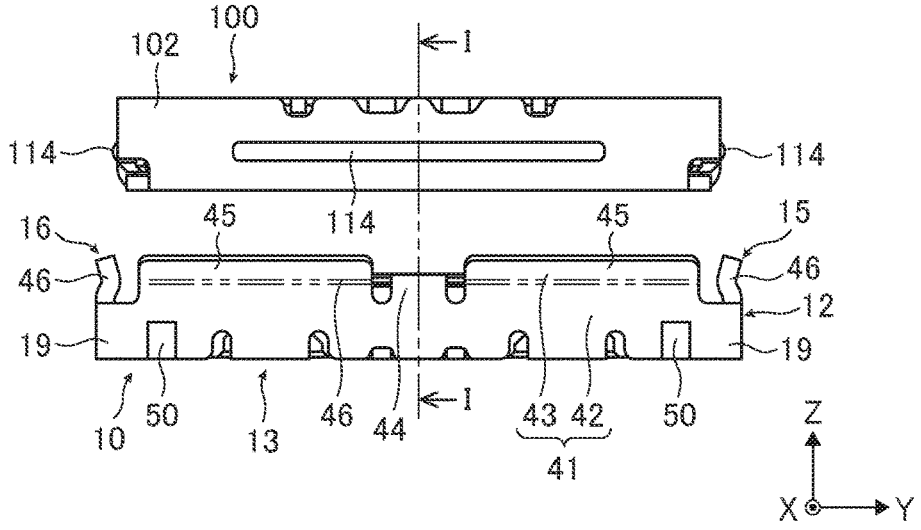
FIG. 10 is a side view of each of the connector and the counter connector before fitting.
Figure 11:
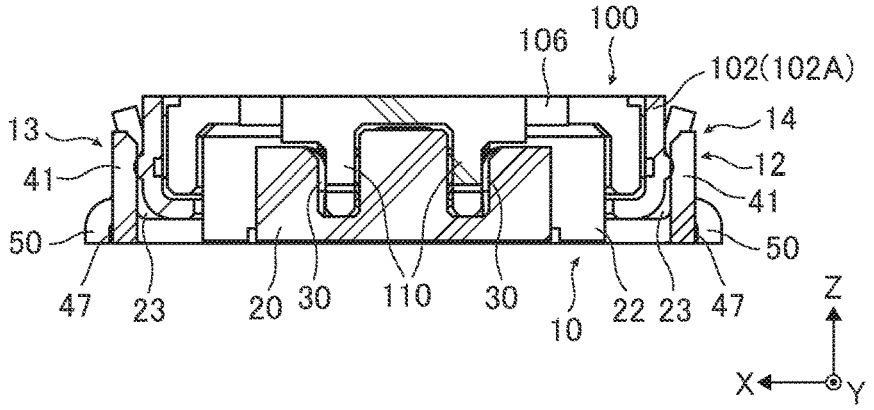
FIG. 11 is a view showing a cross-section taken along I-I in FIG. 9.
Figure 12:
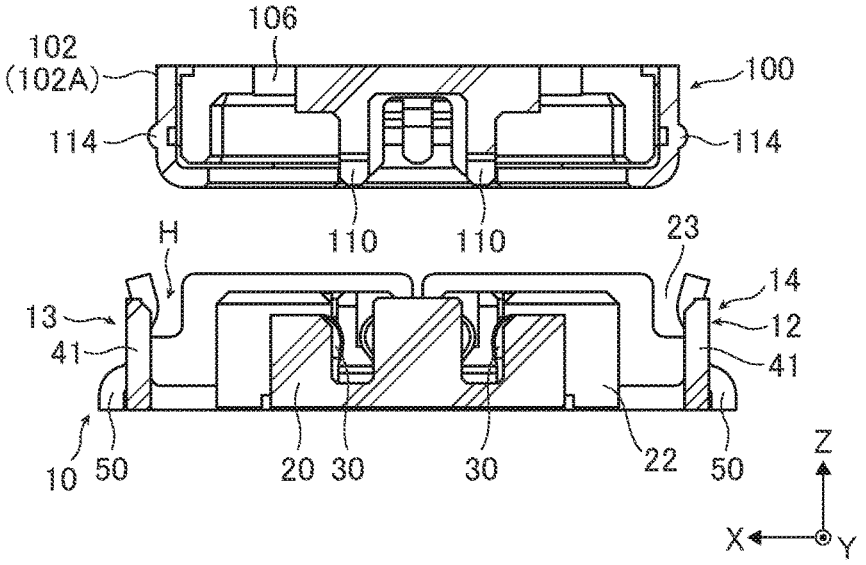
FIG. 12 is a view showing a cross-section taken along I-I in FIG. 10.
Figure 13:
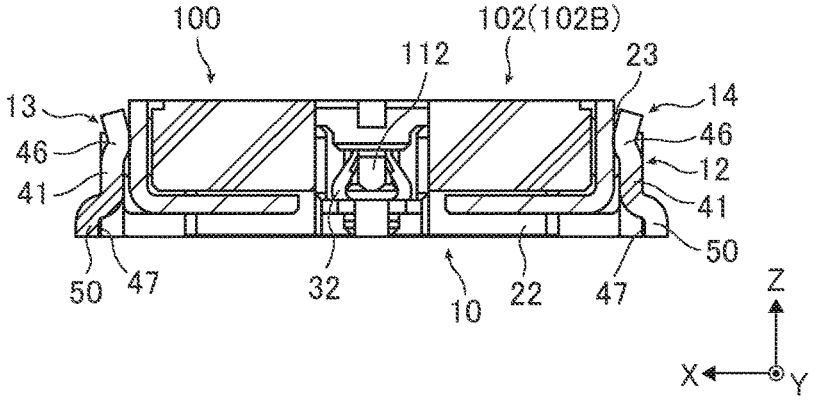
FIG. 13 is a view showing a cross-section taken along J-J in FIG. 9.

The configuration of the connector according to the first embodiment (hereinafter, referred to as "connector 10") is described with reference to FIGS. 1 to 17. FIGS. 11 and 12 show cross-sections taken along I-I in FIGS. 9 and 10, respectively, and each I-I cross-section is a cross-section (XZ plane) passing a Y-directional center position of the connector 10. FIG. 13 shows a cross-section taken along J-J in FIG. 9, and the J-J cross-section is a cross-section (XZ plane) passing a position at which a protrusion portion 50 described later is formed.

Figure 4:
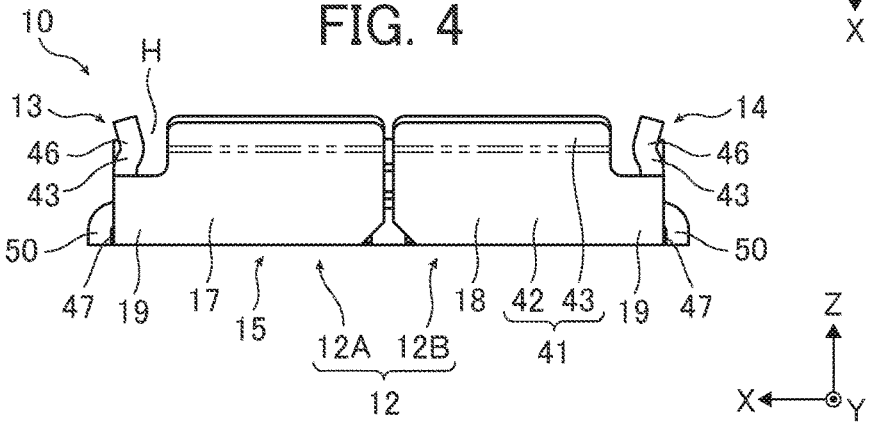
FIG. 4 is a front view of the connector according to the first embodiment of the invention.
Figure 5:
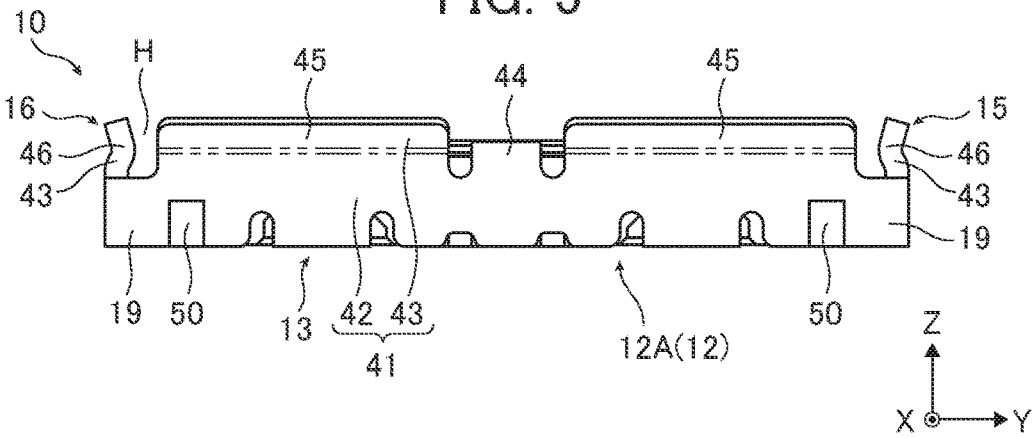
FIG. 5 is a side view of the connector according to the first embodiment of the invention.
Figure 6:
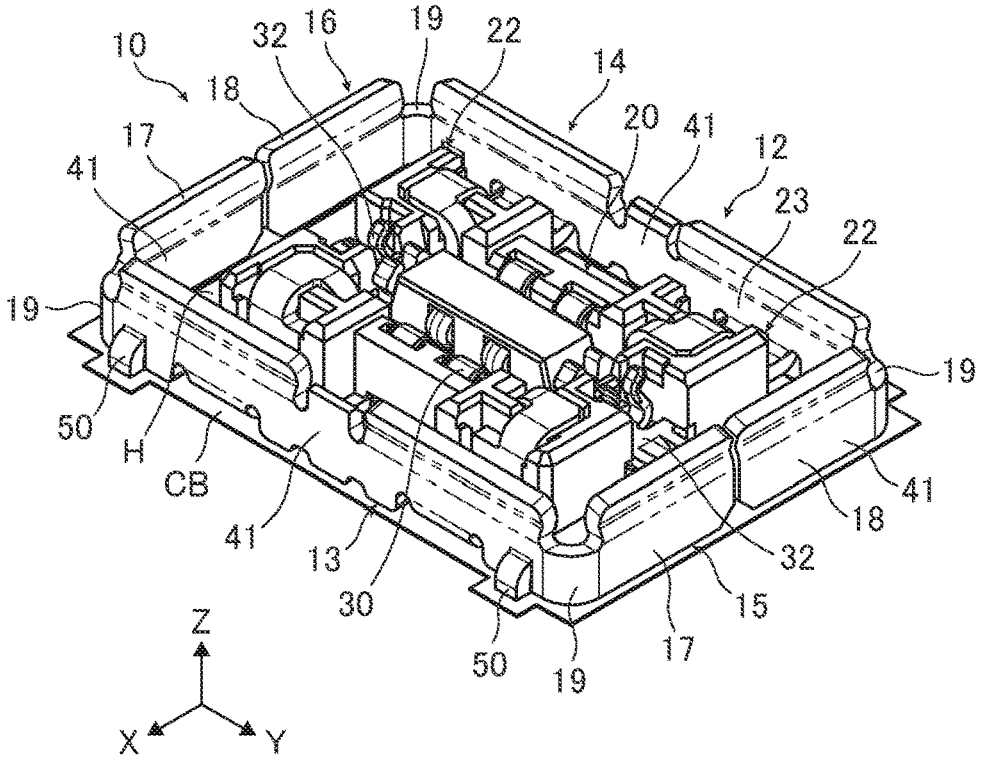
FIG. 6 is a perspective view of the connector mounted on a board.
Figure 7:
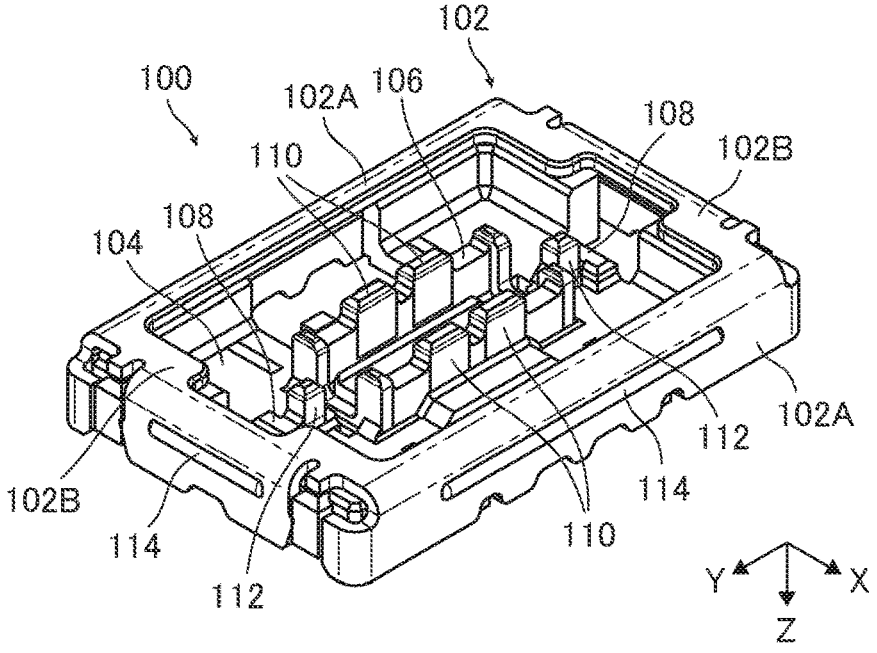
FIG. 7 is a perspective view of a counter connector.
Figure 8:
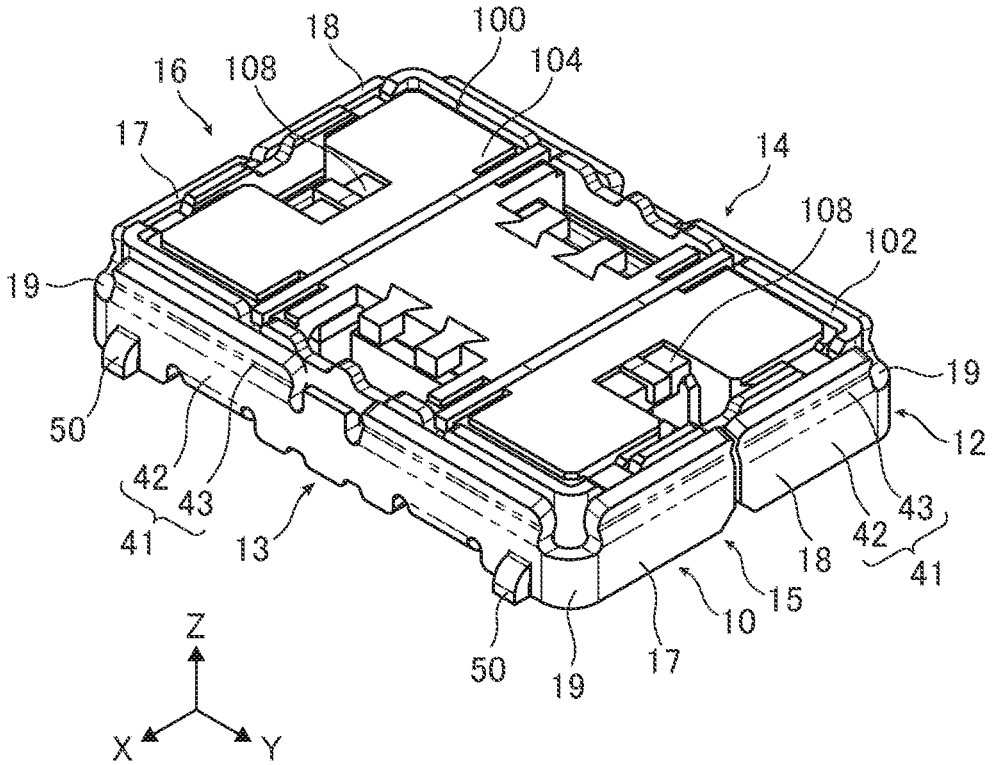
FIG. 8 is a perspective view of the connector fitted with the counter connector.
Figure 9:
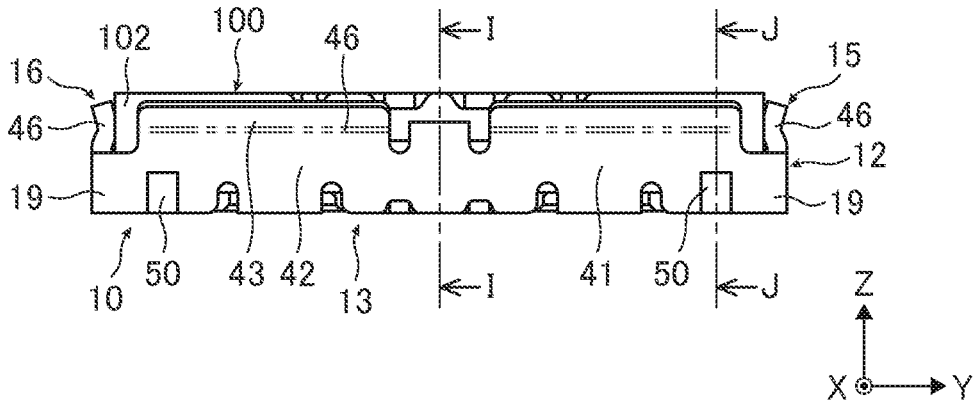
FIG. 9 is a side view of the connector fitted with the counter connector.

The connector 10 is a receptacle connector shown in FIGS. 1 to 5, is mounted on the board CB as shown in FIG. 6, and can be fitted with a counter connector 100 as a plug connector shown in FIG. 7. As shown in FIGS. 8 to 10, the connector 10 is fitted to the counter connector 100 in the vertical direction, i.e., the Z direction. In other words, the Z direction is a direction in which the counter connector 100 is attached to or detached from the connector 10 and corresponds to a "first direction" in the invention. In the following description, the side on which the counter connector 100 is situated when viewed from the connector 10 in the Z direction, i.e., the upper side of the connector 10 is called "+Z side," while the side on which the board CB is situated when viewed from the connector 10, i.e., the lower side of the connector 10 is called "−Z side."

As shown in FIGS. 1 to 5, the connector 10 includes a surrounding wall 12 having a substantially rectangular shape in a plan view, housings 20 and 22 disposed on an inner side of the surrounding wall 12 and surrounded by the surrounding wall 12, and contacts 30 and 32 respectively held by the housings 20 and 22. The housing 20 is disposed at a Y-directional center portion of the connector 10, and a plurality of the contacts 30 are fitted and attached to the housing 20. The housings 22 are disposed separately at one end portion on the +Y side and the other end portion on the −Y side of the connector 10, and one contact 32 is fitted and attached to each housing 22.

The connector 10 is fixed to a surface of the board CB with solder and mounted on the board CB. The solder is provided over the entire circumference of the surrounding wall 12 such that the lower end portion (end portion on the −Z side) of the surrounding wall 12 is bonded to the surface of the board CB.

As shown in FIG. 7, the counter connector 100 includes a counter surrounding wall 102 having a substantially rectangular shape in a plan view, a bottom wall 104 disposed on an inner side of the counter surrounding wall 102, and contact holding portions 106 and 108 protruding from the bottom wall 104. The contact holding portion 106 is disposed at a Y-directional center portion of the counter connector 100, and a plurality of counter contacts 110 are attached to the contact holding portion 106. The contact holding portions 108 are disposed separately at one end portion on the +Y side and the other end portion on the −Y side of the counter connector 100, and one counter contact 112 is attached to each contact holding portion 108.

The counter contacts 110 correspond to the contacts 30 of the connector 10, while the counter contacts 112 correspond to the contacts 32 of the connector 10. In the connector fitting state, each of the contacts 30 and 32 of the connector 10 contacts and is electrically connected to the corresponding counter contact 110 or 112.

Next, the configuration of each portion of the connector 10 is described.

The surrounding wall 12 is an electromagnetic shielding wall, i.e., a shielding frame, having an electrical potential set to a ground potential, and is formed of a metal sheet, for example, a sheet material made of a copper alloy such as brass and bronze or stainless steel. The sheet thickness of the metal sheet to form the surrounding wall 12 is set to 0.06 mm to 0.15 mm, for example.

Figure 2:
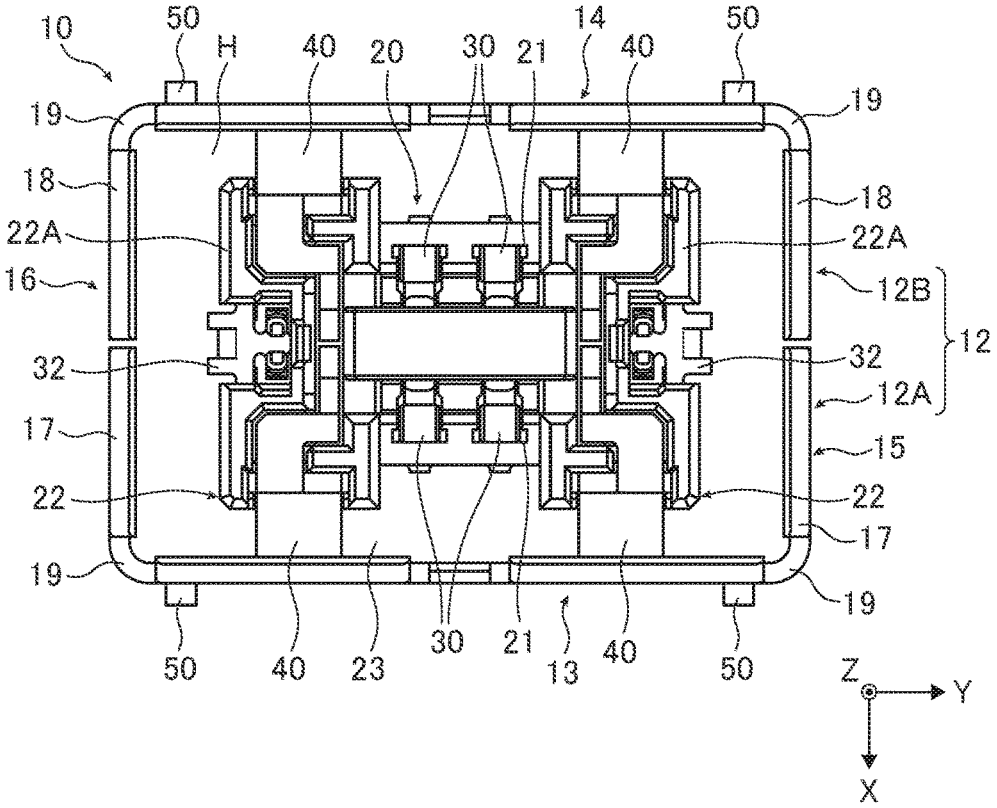
FIG. 2 is a plan view of the connector according to the first embodiment of the invention.
Figure 3:
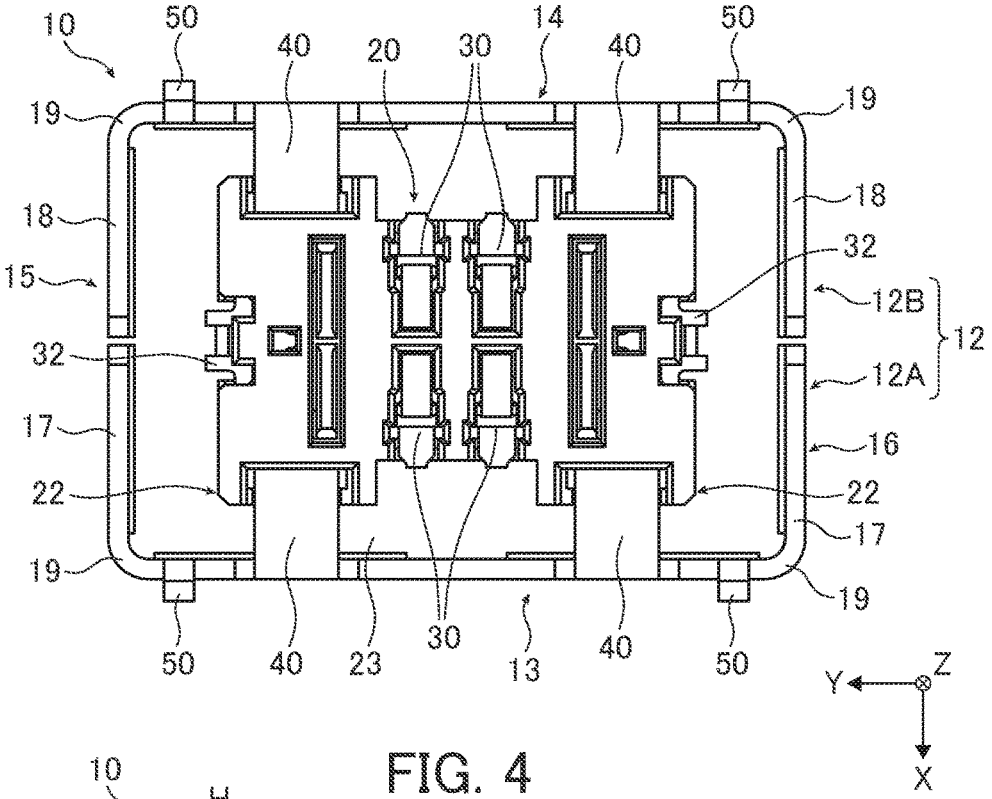
FIG. 3 is a bottom view of the connector according to the first embodiment of the invention.

As shown in FIGS. 2 and 3, the surrounding wall 12 is a frame having a substantially rectangular shape in a plan view, and a recessed space H is formed inside the surrounding wall 12. The housings 20 and 22 are disposed in the recessed space H. In the connector fitting state, as shown in FIG. 8, the entire counter connector 100 is accommodated in the recessed space H.

Figure 1:
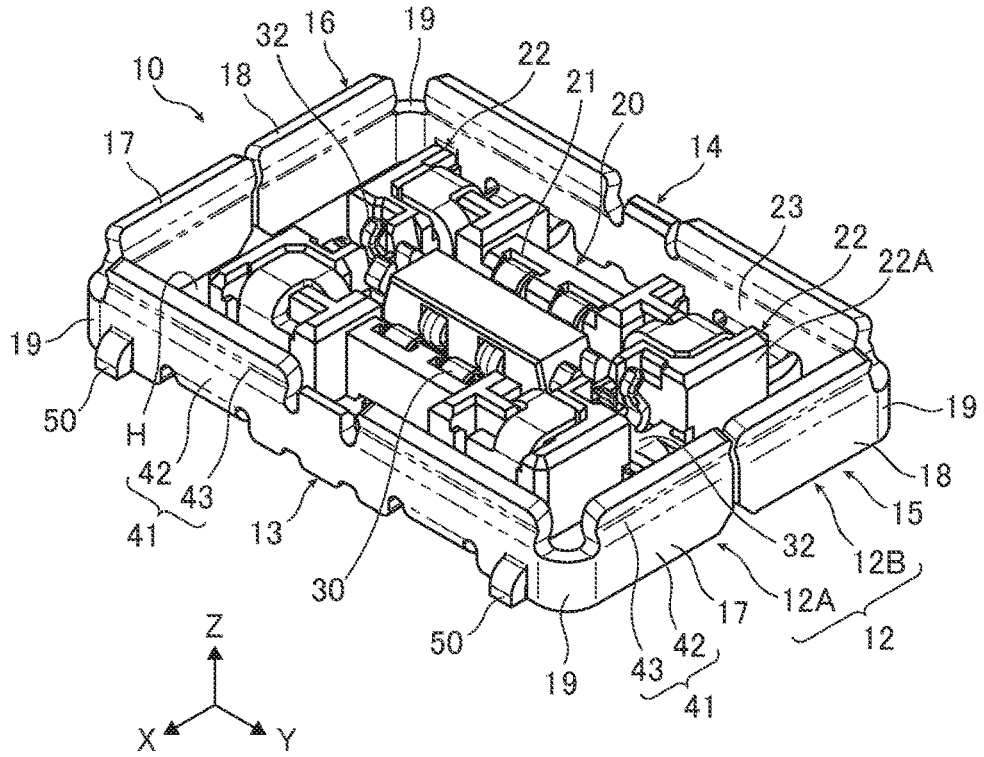
FIG. 1 is a perspective view of a connector according to a first embodiment of the invention.

As shown in FIGS. 1 to 3, the surrounding wall 12 includes a pair of long side walls 13 and 14 aligned in the X direction and a pair of short side walls 15 and 16 aligned in the Y direction. The long side wall 13 or 14 and the short side wall 15 or 16 intersect each other, precisely, intersect orthogonally to each other. The surrounding wall 12 includes a plurality of (in particular, four) corners 19, and the long side walls 13 and 14 are jointed to the short side walls 15 and 16 at the respective corners 19. Each corner 19 is rounded as shown in FIGS. 3 and 4.

The pair of long side walls 13 and 14 are arranged in parallel with each other, extend in the Y direction, and are configured to be symmetrical with each other with respect to an X-directional center position of the connector 10. As shown in FIGS. 2 and 3, a support portion 40 extends inward in the X direction from the end portion on the −Z side (lower end portion) of each of the long side walls 13 and 14. The support portions 40 are portions supporting the housings 20 and 22 and are separately disposed at a position slightly shifted to the +Y side and another position slightly shifted to the −Y side from the Y-directional center position of the connector 10.

The pair of short side walls 15 and 16 are arranged in parallel with each other, extend in the X direction, and are configured to be symmetrical with each other with respect to the Y-directional center position of the connector 10. Each of the short side walls 15 and 16 is divided at the X-directional center position of the connector 10 into two walls 17 and 18 as shown in FIGS. 2 and 4. The two walls 17 and 18 extend toward the same side as the side on which housings 20 and 22 are situated in the X direction and are configured to be symmetrical with each other with respect to the X-directional center position of the connector 10.

The two walls 17 and 18 are aligned linearly in the X direction with a slight gap therebetween. In other words, the surrounding wall 12 is divided into two pieces 12A and 12B in the X direction as shown in FIGS. 2 and 3, the pieces having an identical shape to each other. The two pieces 12A and 12B are symmetrical, specifically, have a mirror image relationship with each other with respect to the X-directional center position of the connector 10.

The piece 12A on the +X side is made of a metal sheet and includes a long side wall 13 on the +X side and a pair of walls 17 disposed on opposite sides of the long side wall 13 as shown in FIGS. 2 and 3. The pair of walls 17 correspond to the +X side walls 17 separately included in the short side wall 15 on the +Y side and the short side wall 16 on the −Y side. The housings 20 and 22 are disposed between the pair of walls 17.

The piece 12B on the −X side is made of a metal sheet and includes a long side wall 14 on the −X side and a pair of walls 18 disposed on opposite sides of the long side wall 14 as shown in FIGS. 2 and 3. The pair of walls 18 correspond to the −X side walls 18 separately included in the short side wall 15 on the +Y side and the short side wall 16 on the −Y side. The housings 20 and 22 are disposed between the pair of walls 18.

The two pieces 12A and 12B configured as above are arranged to oppose to each other while surrounding the housings 20 and 22 to thereby constitute the surrounding wall 12.

The housings 20 and 22 are insulators made of an insulating resin, are disposed in the recessed space H, and are fixed with respect to the surrounding wall 12. The housing 20 protrudes to the +Z side as shown in FIG. 1 and is provided with a plurality of recess-shaped fitting grooves 21 as shown in FIGS. 1 and 2. The contact 30 is fitted into each fitting groove 21.

The housings 22 are disposed separately on the +Y side and the −Y side as described above. The housings 22 on +Y side and the −Y side are arranged symmetrically in the front-back direction and have the same structure.

Each housing 22 includes a pair of rising portions 22A arranged in the X direction with a gap therebetween as shown in FIGS. 1 and 2. The pair of rising portions 22A rise to the +Z side and extend along the X direction. The contact 32 is press-fitted along the Y direction into a space provided between the pair of rising portions 22A and attached thereto.

Figure 14:
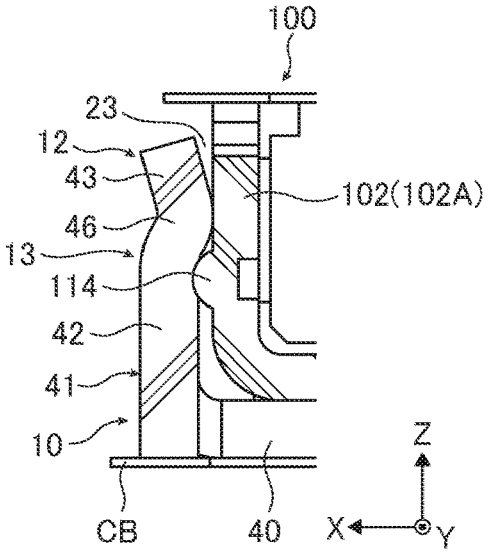
FIG. 14 is an enlarged cross-sectional view showing a contact state between a surrounding wall and a counter surrounding wall.

Between the surrounding wall 12 and the housings 20 and 22 in the recessed space H, a gap 23 having a substantially rectangular shape in a plan view is provided as shown in FIGS. 1 and 2. At the time of connector fitting, the counter surrounding wall 102 of the counter connector 100 enters the gap 23 (see FIG. 11). At this time, an inner peripheral surface of the surrounding wall 12 contacts an outer peripheral surface of the counter surrounding wall 102. In the connector fitting state, as shown in FIGS. 11 and 14, the surrounding wall 12 maintains a state of being in contact with the counter surrounding wall 102 having entered the gap 23. This point is described together with the detailed configuration of each component of the surrounding wall 12.

As shown in FIGS. 1, 5, 6 and 13, the pair of long side walls 13 and 14 each include a wall body 41 and protrusion portions 50 protruding from an outer wall surface of the wall body 41. Since the long side wall 13 on the +X side and the long side wall 14 on the −X side are configured to be symmetrical with each other with respect to the X-directional center position of the connector 10, only the structure of the long side wall 13 on the +X side is described below.

The wall body 41 of the long side wall 13 rises from the board CB to the +Z side and extends in the Y direction. When viewed from the long side wall 13, the X direction is a thickness direction of the surrounding wall 12 (specifically, the long side wall 13) and corresponds to a "second direction" in the invention, while the Y direction orthogonally intersecting the X direction and the Z direction corresponds to a "third direction" in the invention. As shown in FIG. 5 or other drawings, the wall body 41 includes a lower portion 42 situated on the board CB side (−Z side) and an upper portion 43 extending from the lower portion 42 to the +Z side.

The lower portion 42 continuously extends in the Y direction, and the −Z side end (end on the board CB side) of the lower portion 42 is in contact with the board CB. As shown in FIGS. 1 to 3 and 5, at a position slightly shifted to the +Y side and a position slightly shifted to the −Y side from a Y-directional center position of the lower portion 42, the end portion on the −Z side of the lower portion 42 is bent inward in the X direction and joined to the support portions 40 described above.

As shown in FIGS. 1 and 5 and other drawings, the upper portion 43 is divided into multiple pieces in the Y direction, specifically, includes a center portion 44 and side portions 45 separately situated on the +Y side and the −Y side of the center portion 44, and these portions are disposed away from one another. The center portion 44 extends straight to the +Z side.

Each side portion 45 extends to +Z side farther than the center portion 44 and is curved in a substantially V shape such that its end portion on the +Z side extends outward in the X direction, as evident from FIGS. 1 and 5 or other drawings. In other words, a surrounding wall projection portion 46 protruding inward in the X direction is provided at a surface (i.e., inner wall surface) of the side portion 45 of the long side wall 13, the surface facing the housing 20 and 22 side.

Since the surrounding wall projection portion 46 is provided, the counter connector 100 is easily guided into the recessed space H of the connector 10 at the time of connector fitting, and a contact state between the long side wall 13 and the counter surrounding wall 102 is stabilized in the connector fitting state. To be more specific, a long side wall 102A of the counter surrounding wall 102 enters the gap 23 between the long side wall 13 and the housings 20 and 22 in the connector fitting. At this time, since the side portion 45 is curved such that its end portion on the +Z side extends outward in the X direction, the long side wall 102A of the counter surrounding wall 102 easily enters the gap 23.

As shown in FIG. 7, the outer peripheral surface of the counter surrounding wall 102, specifically an outer wall surface of the long side wall 102A is provided with a counter surrounding wall projection portion 114 projecting outward. When the long side wall 102A of the counter surrounding wall 102 enters the gap 23 for the connector fitting, the counter surrounding wall projection portion 114 contacts the surrounding wall projection portion 46 provided to the side portion 45 of the long side wall 13 (see FIGS. 12 to 14).

When the connector fitting is completed, as shown in FIG. 14, the counter surrounding wall projection portion 114 goes into a space under (on the −Z side of) the surrounding wall projection portion 46 and contacts the surrounding wall projection portion 46. That is, in the connector fitting state, the surrounding wall projection portion 46 contacts (specifically, is engaged with) the counter surrounding wall projection portion 114 in the Z direction. With this configuration, a contact state between the long side wall 13 of the surrounding wall 12 and the long side wall 102A of the counter surrounding wall 102 is stabilized, whereby the connector fitting state is satisfactorily maintained.

Figure 15:
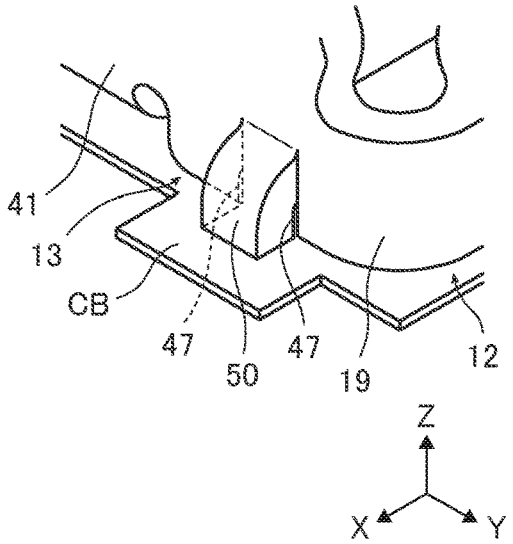
FIG. 15 is an enlarged view of a vicinity of a protrusion portion in the perspective view of the connector mounted on the board.
Figure 17:
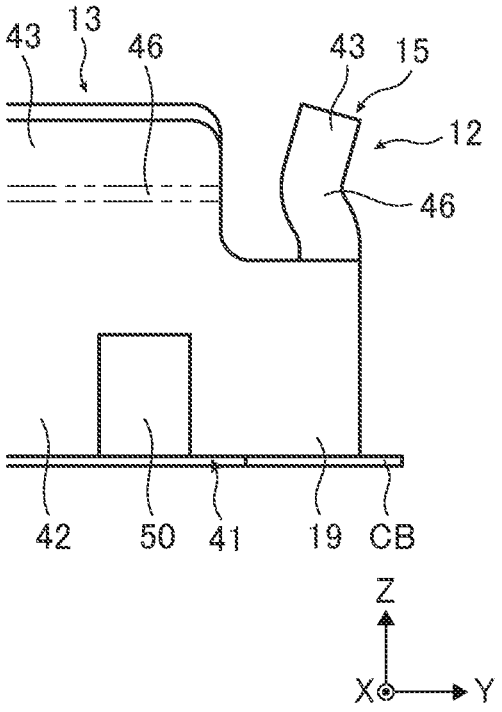
FIG. 17 is an enlarged view of a vicinity of the protrusion portion in a side view of the connector mounted on the board.
Figure 18:
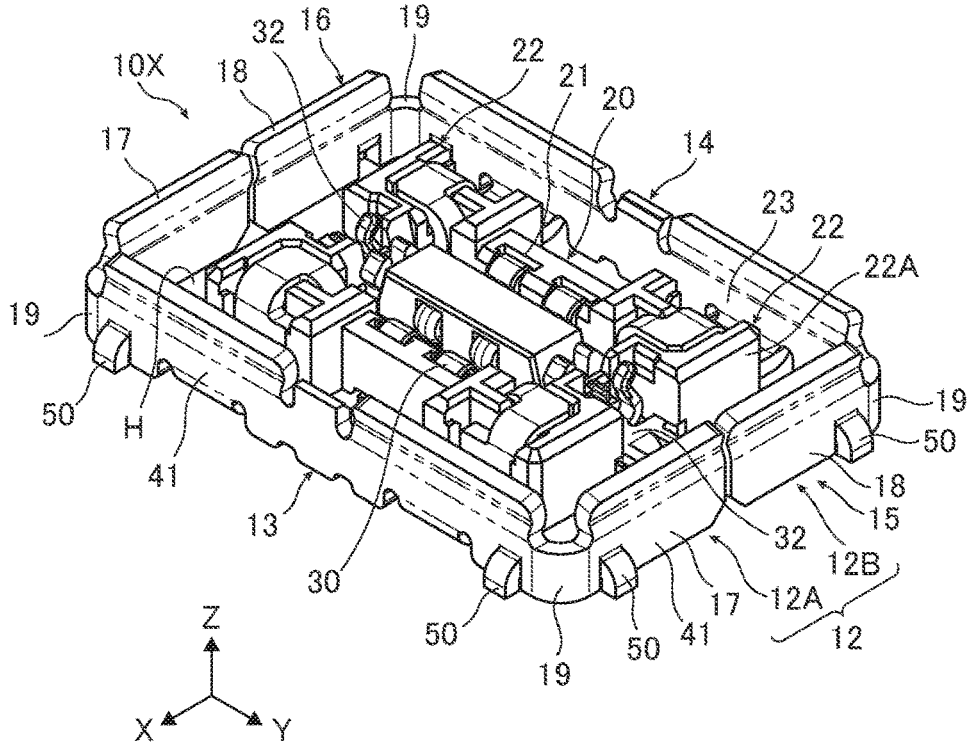
FIG. 18 is a perspective view of a connector according to a modification of the first embodiment of the invention.
Figure 19:
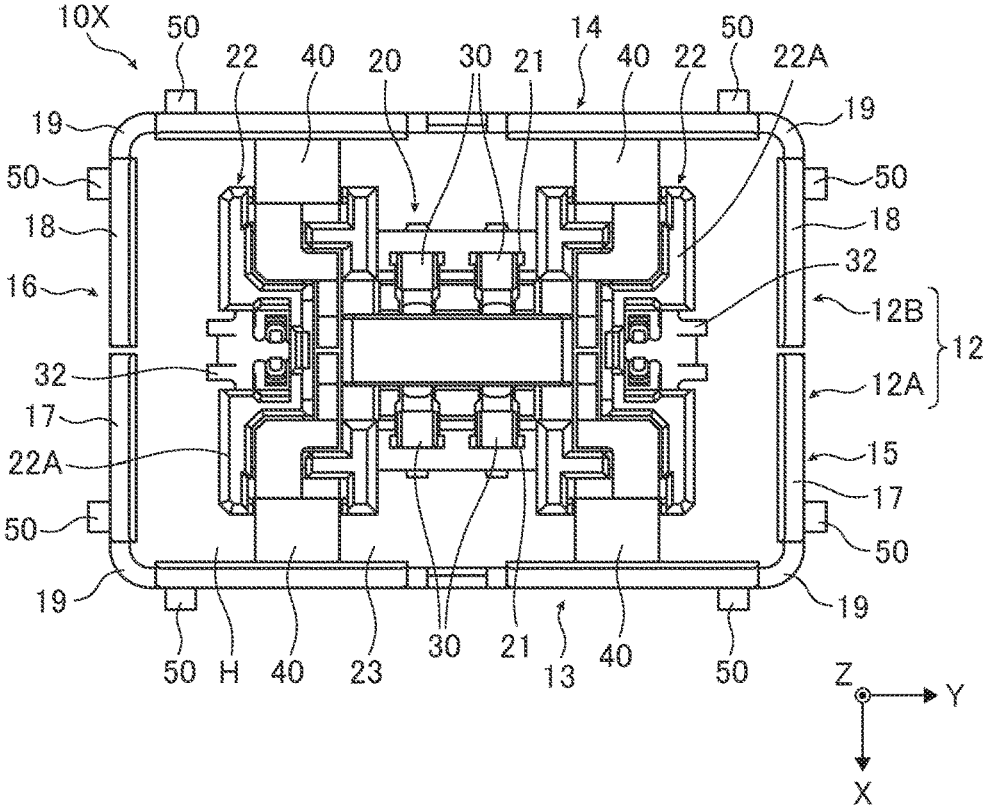
FIG. 19 is a plan view of the connector according to the modification of the first embodiment of the invention.
Figure 20:
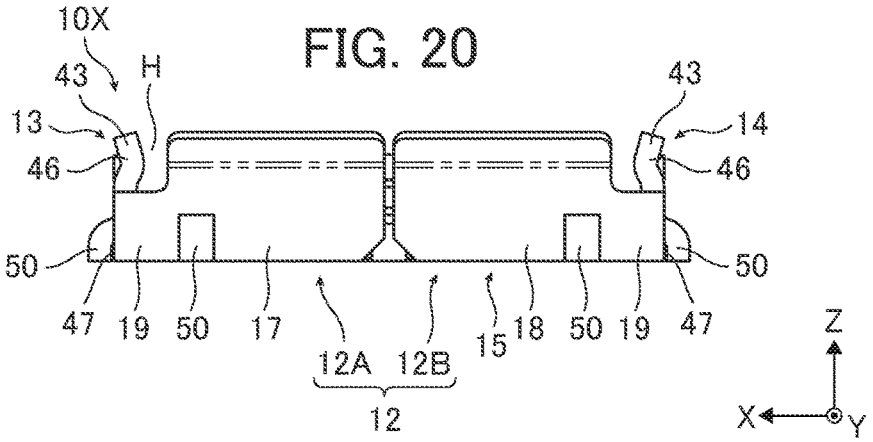
FIG. 20 is a front view of the connector according to the modification of the first embodiment of the invention.
Figure 21:
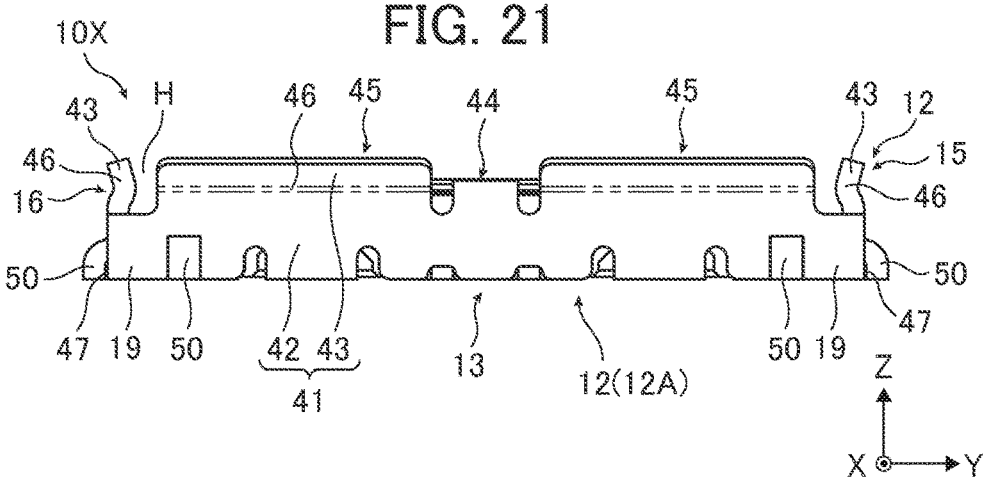
FIG. 21 is a side view of the connector according to the modification of the first embodiment of the invention.

As shown in FIGS. 1, 15 and 17, the protrusion portion 50 protrudes outward in the X direction (i.e., second direction). The −Z side end (end situated on the board CB side) of the protrusion portion 50 is in contact with the board CB, specifically, is fixed to the board CB with solder.

Since the protrusion portion 50 is provided to the long side wall 13, a strength against an outward force (moment) acting on the long side wall 13 in the connector fitting or detachment can be enhanced. To be more specific, in the connector fitting or detachment, the long side wall 102A of the counter surrounding wall 102 contacts the long side wall 13 of the surrounding wall 12 as described above, whereby a force acts on the long side wall 13 of the surrounding wall 12 from the counter surrounding wall 102 toward the outside in the X direction. When prying (shaking movement around the central axis extending in the X direction or the Y direction) of the counter connector 100 occurs in the process of connector fitting or detachment, the outward force becomes larger. For example, when the connector 10 disposed at a place which is hardly seen by an operator is fitted to the counter connector 100, the prying may easily occur, and the larger outward force may act on the long side wall 13.

When the outward force acts on and deforms the surrounding wall 12 including the long side wall 13, the connector 10 may no longer be appropriately fitted to the counter connector 100, whereby signal transmission between the connectors may be obstructed. Since deformation of the surrounding wall 12 may lead to such a failure that the positioning of the connector 10 cannot be normally carried out, electrical connection of the surrounding wall 12 to a ground potential may fail, whereby the function as electromagnetic shield may be impaired.

In contrast, in the first embodiment of the invention, since the long side wall 13 is provided with the protrusion portion 50 and the −Z side end of the protrusion portion 50 is in contact with the board CB, even when an outward force acts on the long side wall 13 from the counter connector 100, a reaction force can be appropriately taken from the board CB side and resist the outward force. As a result, the strength of the surrounding wall 12 including the long side wall 13 can be enhanced, whereby deformation of the surrounding wall 12 can be satisfactorily suppressed.

When the surrounding wall projection portion 46 and the counter surrounding wall projection portion 114 are provided to the inner peripheral surface of the surrounding wall 12 and the outer peripheral surface of the counter surrounding wall 102, respectively, the surrounding wall 12 can more easily contact the counter surrounding wall 102. With this configuration, prying may easily occur, whereby the larger outward force may act on the surrounding wall 12. Therefore, the effect of enhancing the strength of the surrounding wall 12 against an outward force achieved by providing the protrusion portion 50 would be more significant.

Describing an example of the configuration of the protrusion portion 50, the protrusion portion 50 is formed by having the wall body 41 constituting the long side wall 13 subjected to lancing process (cutting and bending the wall body 41 constituting the long side wall 13). To be more specific, as shown in FIG. 15, the long side wall 13 is provided with a pair of cuts 47 at positions separate from each other in the Y direction (i.e., third direction). The protrusion portion 50 is configured such that, of the long side wall 13, a portion situated between the pair of cuts 47 in the Y direction is bent so as to protrude outward in the X direction.

A processing method for providing the protrusion portion 50 is not limited to the lancing process and may be other processing methods. The protrusion portion 50 may be provided to the long side wall 13 by preparing a metal piece corresponding to the protrusion portion 50 in addition to a metal sheet constituting the long side wall 13 and bonding them by welding or other methods.

Figure 16:
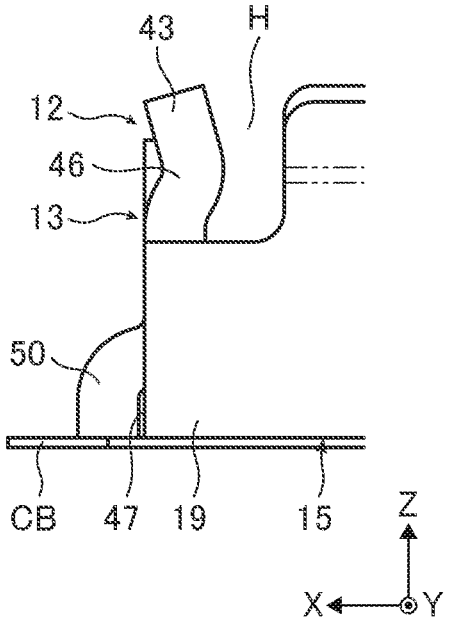
FIG. 16 is an enlarged view of a vicinity of the protrusion portion in a front view of the connector mounted on the board.

As shown in FIGS. 15 to 17, the protrusion portion 50 protrudes outward in the X direction from the wall body 41 and extends to the −Z side (the board CB side) while being gently curved from its upper end (+Z side end). As a protrusion amount of the protrusion portion 50 in the X direction becomes larger, the strength of the surrounding wall 12 against an outward force can be enhanced, but the size of the connector 10 including the surrounding wall 12 increases. Considering this point, the protrusion amount of the protrusion portion 50 may be one to two times, preferably about one time the sheet thickness of the wall body 41.

While at least one protrusion portion 50 may be provided to the surrounding wall 12, in order to effectively enhance the strength against an outward force, a plurality of protrusion portions are preferably provided as shown in FIGS. 1 and 2 and other drawings. While a position where the protrusion portion 50 is provided in the surrounding wall 12 is not particularly limited, in order to effectively enhance the strength against an outward force, the protrusion portion 50 is preferably provided in the vicinity of the corner 19 as shown in FIGS. 1 and 2. To be more specific, the corners 19 situated adjacent to the opposite end portions of the long side wall 13 in the Y direction correspond to two corners 19 aligned in the Y direction. The protrusion portion 50 is preferably provided closer to either of the corners 19 than the center position between these two corners 19 in the Y direction.

Next, the configuration of the pair of short side walls 15 and 16 is described. The short side wall 15 on the +Y side and the short side wall 16 on the −Y side are configured to be symmetrical with each other with respect to the Y-directional center position of the connector 10; therefore, only the configuration of the short side wall 15 on the +Y side is described below. The short side wall 15 is divided into the two walls 17 and 18 as described above, and each of the walls 17 and 18 is consisted of the wall body 41 as shown in FIGS. 1 and 4. The wall body 41 of each of the walls 17 and 18 has the substantially same structure as the wall body 41 of each of the long side walls 13 and 14 while having a different lateral width (length in the third direction). When viewed from the short side wall 15, the Y direction is the thickness direction of the surrounding wall 12 (specifically the short side wall 15) and corresponds to the "second direction" in the invention, while the X direction orthogonally intersecting the Y direction and the Z direction corresponds to the "third direction" in the invention.

The upper portion 43 provided to the wall body 41 of the short side wall 15 is curved in a substantially V shape such that its end portion on the +Z side extends outward in the Y direction, i.e., the upper portion 43 is provided with the surrounding wall projection portion 46. When the short side wall 102B of the counter surrounding wall 102 enters the gap 23 between the short side wall 15 and the housing 22 in the recessed space H for the connector fitting, the counter surrounding wall projection portion 114 provided to the short side wall 102B contacts the surrounding wall projection portion 46 provided to the short side wall 15. At the time when the connector fitting is completed, the counter surrounding wall projection portion 114 goes into a space under (on the −Z side of) the surrounding wall projection portion 46 and contacts the surrounding wall projection portion 46. As a result, a contact state between the short side wall 15 of the surrounding wall 12 and the short side wall 102B of the counter surrounding wall 102 is stabilized, whereby the connector fitting state is satisfactorily maintained.

While no protrusion portion 50 is provided to the short side wall 15 in the connector 10 shown in FIGS. 1 to 4, the protrusion portion 50 is preferably provided also to the short side wall 15 as in a connector 10X shown in FIGS. 18 to 21. FIGS. 18 to 21 are views showing the connector 10X according to a modification of the first embodiment.

As described above, it is more preferable that the protrusion portion 50 is provided to each of the two walls (i.e., the long side wall and the short side wall) joined via the corner 19 in the surrounding wall 12. With this configuration, the strength of the surrounding wall 12 against an outward force can be further enhanced. The protrusion portion 50 provided to the short side wall 15 protrudes outward in the Y direction, and its −Z side (board CB side) end is fixed to the board CB with solder. The protrusion portion 50 provided to the short side wall 15 is preferably provided in the vicinity of the corner 19 as shown in FIGS. 18 to 21, specifically at a position closer to each corner 19 than the center position between the two corners 19 arranged in the X direction.

Configuration of Connector According to Second Embodiment

Figure 22:
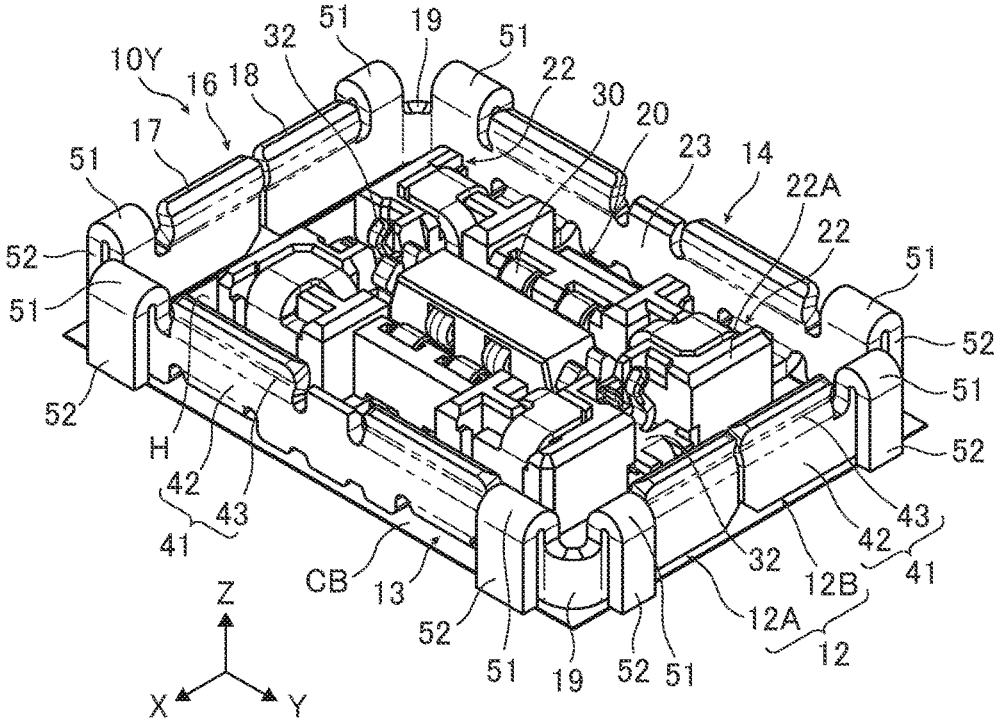
FIG. 22 is a perspective view of a connector according to a second embodiment of the invention.
Figure 23:
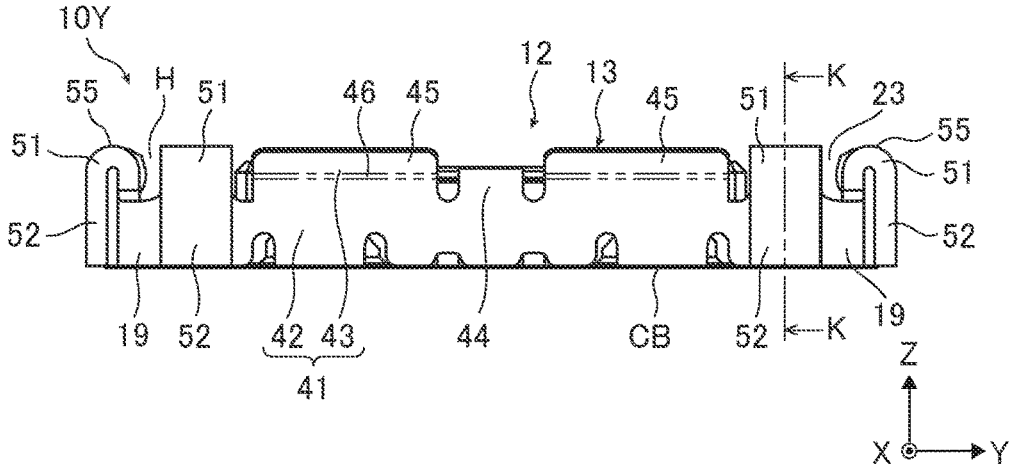
FIG. 23 is a side view of the connector according to the second embodiment of the invention and a board.
Figure 24:
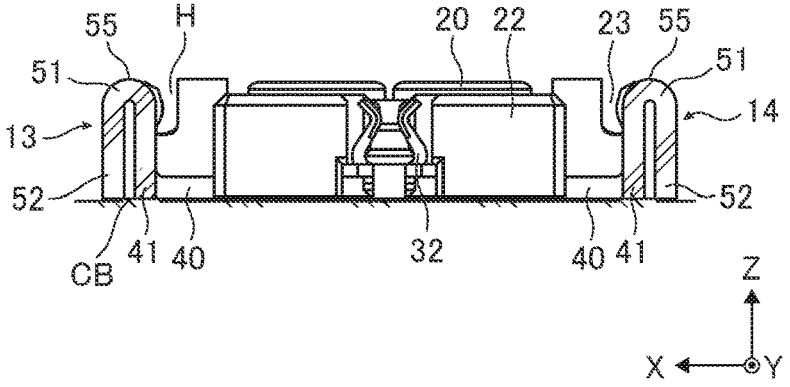
FIG. 24 is a view showing a cross-section corresponding to a cross-section taken along K-K in FIG. 23.
Figure 25:
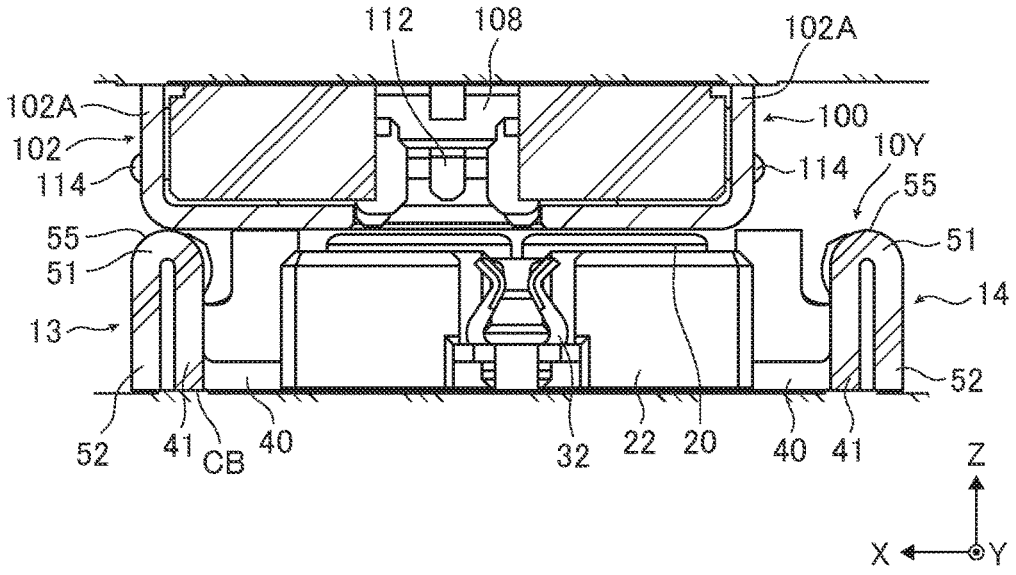
FIG. 25 is a cross-sectional view showing the connector according to the second embodiment of the invention in the process of being fitted to a counter connector, the view corresponding to the cross-section taken along K-K in FIG. 23.
Figure 26:
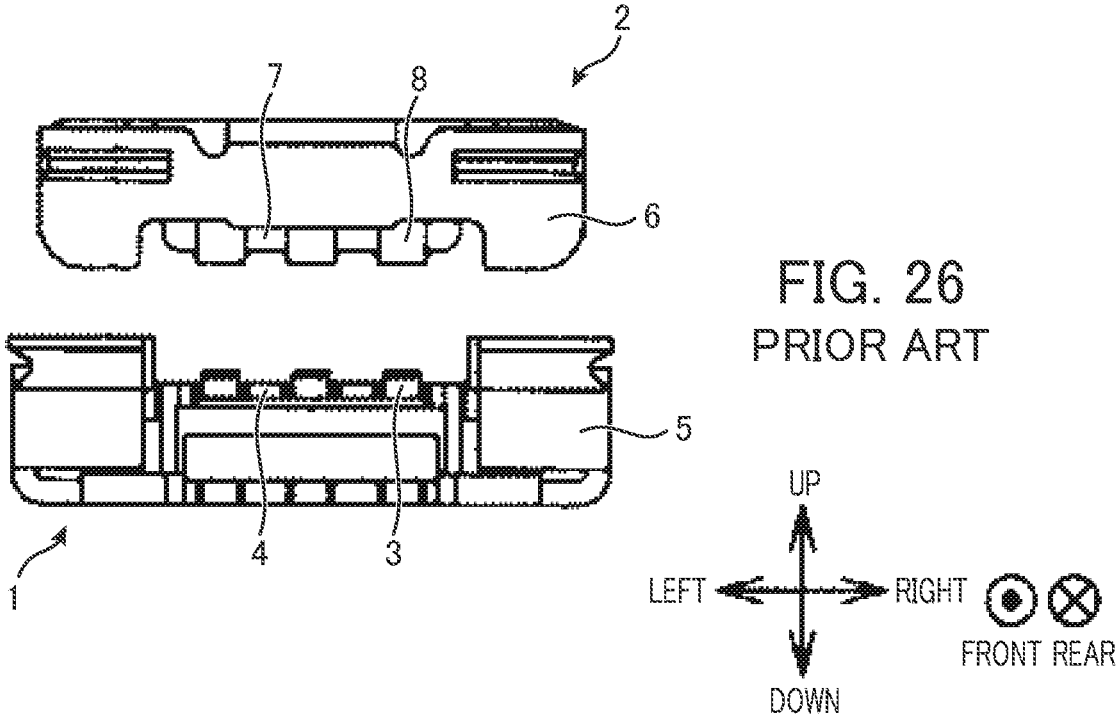
FIG. 26 PRIOR ART
FIG. 26 is a view showing each of a conventional connector and a counter connector.
Figure 27:
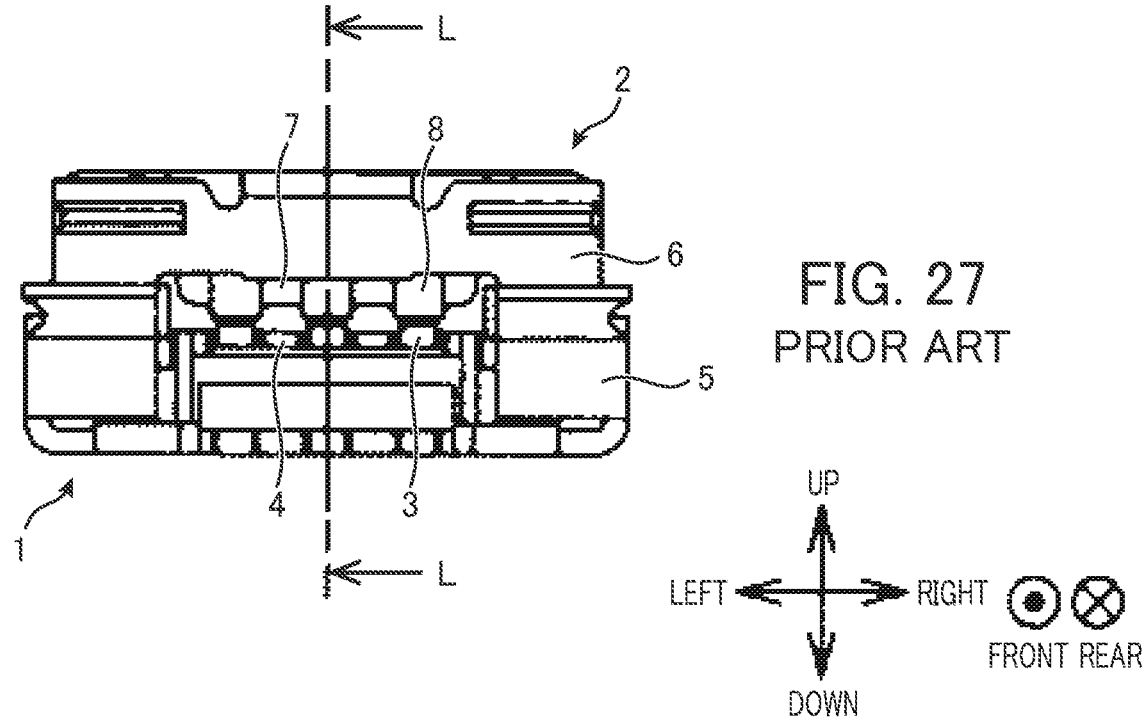
FIG. 27 PRIOR ART
FIG. 27 is a view showing a state where the conventional connector is fitted to the counter connector.

The configuration of a connector according to the second embodiment (hereinafter, referred to as "connector 10Y") is described with reference to FIGS. 22 to 25. FIG. 24 shows a cross-section taken along K-K in FIG. 23, and the K-K cross-section is a cross-section (XZ plane) passing a position at which a bending portion 51 and an extension portion 52 described later are formed. FIG. 25 is a view showing a state where the connector 10Y is in the process of being fitted to the counter connector 100 and showing a cross-section corresponding to the K-K cross-section.

In the following description, differences of the second embodiment from the first embodiment are mainly described, and of components shown in FIGS. 22 to 25, the same components as those in the first embodiment are assigned the same reference numerals as those in the first embodiment.

In the first embodiment, the surrounding wall 12 is provided with the protrusion portion 50 in order to enhance the strength of the surrounding wall 12 against an outward force. In the second embodiment, instead of the protrusion portion 50, the bending portion 51 and the extension portion 52 are provided as shown in FIGS. 22 to 25.

The bending portion 51 is a portion connected with an end portion on the +Z side (end portion situated on the opposite side from the board CB side) of the wall body 41 constituting the surrounding wall 12 in the Z direction. As shown in FIGS. 22 and 23, the bending portion 51 is bent in an arc-shape, specifically, an inverted U shape, and includes roundness 55 at a surface on the +Z side (opposite side from the board CB). With this configuration, in the process of connector fitting, the counter connector 100 can be guided into a recessed space H of the connector 10Y (i.e., the inner side of the surrounding wall 12) by use of the roundness 55 of the bending portion 51 as shown in FIG. 25. As a result, the connector 10Y can be fitted to the counter connector 100 more easily. It should be noted that the bending portion 51 may have a shape not having the roundness 55, e.g., a linearly bent shape.

The extension portion 52 extends from the bending portion 51 to the −Z side (board CB side in the Z direction), and its tip (−Z side end) is in contact with the board CB as shown in FIG. 24 and is fixed to the board CB with solder. In addition, the extension portion 52 is situated outside the wall body 41 in the thickness direction (i.e., second direction) of each portion of the surrounding wall 12 and faces the wall body 41, as shown in FIGS. 22 to 25.

Since the bending portion 51 and the extension portion 52 are provided to the surrounding wall 12, and the −Z side end of the extension portion 52 is in contact with the board CB, the strength of the surrounding wall 12 against an outward force can be enhanced as in the case of providing the protrusion portion 50.

While it suffices if at least one pair of the bending portion 51 and the extension portion 52 are provided to the surrounding wall 12, a plurality of pairs of the bending portions 51 and the extension portions 52 are preferably provided in order to effectively enhance the strength of the surrounding wall 12 against an outward force. It is more preferable that as shown in FIG. 22, the bending portion 51 and the extension portion 52 are provided to each of the pair of long side walls 13 and 14 and each of the pair of short side walls 15 and 16.

While a position where the bending portion 51 and the extension portion 52 are provided in the surrounding wall 12 is not particularly limited, the bending portion 51 and the extension portion 52 are preferably provided in the vicinity of the corner 19 as shown in FIG. 22 in order to effectively enhance the strength of the surrounding wall 12 against an outward force. That is, the bending portion 51 and the extension portion 52 are preferably provided at a position closer to each corner 19 than the center position between two corners 19 arranged in the X direction or the Y direction.

In addition, the bending portion 51 and the extension portion 52 may be provided together with the protrusion portion 50 to the surrounding wall 12.

Other Embodiments

While the connector of the invention has been described above with reference to specific examples, the foregoing embodiments are mere examples used to facilitate the understanding of the invention, and there may be other embodiments. For instance, the outer shape of the surrounding wall 12 is a rectangular shape elongated in the Y direction in the foregoing embodiments, but the invention is not limited thereto. The outer shape of the surrounding wall may be a circular shape, another quadrilateral shape than a rectangular shape such as a trapezoidal shape or a rhomboid shape, or a polygonal shape other than a rectangular shape.

In the foregoing embodiments, the −Z side end of the protrusion portion 50 or the −Z side end of the extension portion 52 is fixed to the board CB with solder, but the invention is not limited thereto. For example, the −Z side end of the protrusion portion 50 or the −Z side end of the extension portion 52 may not be bonded to but merely contact the board CB.

In the foregoing embodiments, the surrounding wall 12 has a configuration in which the surrounding wall is divided into the two pieces 12A and 12B having an identical shape, but the invention is not limited thereto. For instance, the surrounding wall may be consisted of a single continuous body (specifically, a frame body that is inseparable).

What is claimed is:

1. A connector that can be fitted with a counter connector in a first direction and is mounted on a board, the connector comprising:

a contact that contacts a counter contact of the counter connector;

a housing to which the contact is fitted and attached; and a surrounding wall disposed to surround the housing, wherein a gap is provided between the housing and the surrounding wall, wherein in a state where the connector is fitted with the counter connector, the surrounding wall is in contact with a counter surrounding wall of the counter connector that has entered the gap, wherein the surrounding wall is provided with a protrusion portion protruding outward in a second direction intersecting the first direction, wherein an end portion of the protrusion portion on a side on which the board is situated in the first direction is in contact with the board, and wherein the surrounding wall includes portions each disposed on opposite sides of and adjacently to the protrusion portion in a third direction intersecting the first direction and the second direction, the portions hold the protrusion portion therebetween.

2. The connector according to claim 1, wherein the protrusion portion protrudes outward in the second direction from an outer wall surface of a wall body of the surrounding wall, wherein the surrounding wall is provided with a pair of cuts at positions apart from each other in the third direction, and wherein the protrusion portion is formed by bending, of the surrounding wall, a portion situated between the pair of cuts in the third direction to protrude outward in the second direction.

3. The connector according to claim 2, wherein the surrounding wall includes a plurality of corners, and wherein the protrusion portion is provided at a position closer to one of two aligned corners of the plurality of corners than a center position between the two aligned corners.

4. The connector according to claim 1, wherein the end portion on the board side of the protrusion portion in the first direction is fixed to the board with solder.

5. The connector according to claim 4, wherein the surrounding wall includes a plurality of corners, and wherein the protrusion portion is provided at a position closer to one of two aligned corners of the plurality of corners than a center position between the two aligned corners.

6. The connector according to claim 1, wherein the surrounding wall includes a plurality of corners, and wherein the protrusion portion is provided at a position closer to one of two aligned corners of the plurality of corners than a center position between the two aligned corners.

7. The connector according to claim 6, wherein in the surrounding wall, two walls intersecting each other are joined via one of the plurality of corners, and wherein the protrusion portion is provided at each of the two walls joined via one of the plurality of corners.

8. The connector according to claim 1, wherein the surrounding wall is an electromagnetic shielding wall having an electrical potential set to a ground potential.

9. The connector according to claim 1, wherein the surrounding wall is divided into two pieces having an identical shape, wherein each of the two pieces is provided with a pair of walls extending to a side on which the housing is situated, wherein the housing is disposed between the pair of walls, and wherein the two pieces are arranged so as to oppose to each other while surrounding the housing.

10. The connector according to claim 1, wherein a surface facing a side on which the housing is situated in the surrounding wall is provided with a surrounding wall projection portion protruding inward in the second direction, and wherein in a state where the connector is fitted with the counter connector, the surrounding wall projection portion is in contact with a counter surrounding wall projection portion provided to an outer peripheral surface of the counter surrounding wall in the first direction.

11. A connector that can be fitted with a counter connector in a first direction and is mounted on a board, the connector comprising:

a contact that contacts a counter contact of the counter connector;

a housing to which the contact is fitted and attached; and a surrounding wall disposed to surround the housing, wherein a gap is provided between the housing and the surrounding wall, wherein in a state where the connector is fitted with the counter connector, the surrounding wall is in contact with a counter surrounding wall of the counter connector that has entered the gap, wherein the surrounding wall includes a wall body rising from the board in the first direction, a bending portion connected to the wall body on an opposite side from the board in the first direction, and an extension portion extending from the bending portion to a side on which the board is situated in the first direction, wherein the extension portion is situated outside the wall body in a second direction intersecting the first direction, and an end on the board side of the extension portion in the first direction is in contact with the board, wherein the bending portion includes a plurality of bending portions disposed separately from one another in a third direction intersecting the first direction and the second direction, wherein the extension portion is provided at and extends from each of the bending portions, and wherein each of the bending portions has a same width in the third direction as that of the extension portion extending from each of the bending portions.

12. The connector according to claim 11, wherein the bending portion is bent in an arc-shape and has a roundness on an opposite side from the board in the first direction.

13. The connector according to claim 12, wherein the surrounding wall includes a plurality of corners, and wherein the bending portion and the extension portion are provided at a position closer to one of two aligned corners of the plurality of corners than a center position between the two aligned corners.

14. The connector according to claim 11, wherein the surrounding wall includes a plurality of corners, and wherein the bending portion and the extension portion are provided at a position closer to one of two aligned corners of the plurality of corners than a center position between the two aligned corners.

15. The connector according to claim 11, wherein the surrounding wall is an electromagnetic shielding wall having an electrical potential set to a ground potential.

16. The connector according to claim 11, wherein the surrounding wall is divided into two pieces having an identical shape, wherein each of the two pieces is provided with a pair of walls extending to a side on which the housing is situated, wherein the housing is disposed between the pair of walls, and wherein the two pieces are arranged so as to oppose to each other while surrounding the housing.

17. The connector according to claim 11, wherein a surface facing a side on which the housing is situated in the surrounding wall is provided with a surrounding wall projection portion protruding inward in the second direction, and wherein in a state where the connector is fitted with the counter connector, the surrounding wall projection portion is in contact with a counter surrounding wall projection portion provided to an outer peripheral surface of the counter surrounding wall in the first direction.

* * * * *